US006862908B2

(12) United States Patent
Seki

(10) Patent No.: US 6,862,908 B2
(45) Date of Patent: Mar. 8, 2005

(54) KEY DEVICE AND METHOD FOR ASSEMBLING THE SAME

(75) Inventor: Yoshiyuki Seki, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 8 days.

(21) Appl. No.: 10/277,296

(22) Filed: Oct. 22, 2002

(65) Prior Publication Data

US 2003/0074938 A1 Apr. 24, 2003

(30) Foreign Application Priority Data

Oct. 23, 2001 (JP) ..... 2001-324580

(51) Int. Cl.[7] ..... E05B 19/04
(52) U.S. Cl. ..... 70/408; 70/395
(58) Field of Search ..... 70/393, 395, 402, 70/405, 408, 257, 456 R

(56) References Cited

U.S. PATENT DOCUMENTS

| | | | | |
|---|---|---|---|---|
| 3,841,120 A | * | 10/1974 | Gartner | 70/408 |
| 4,276,582 A | * | 6/1981 | Burnett | 70/456 R |
| 4,922,736 A | * | 5/1990 | Tanaka et al. | 70/408 |
| 5,730,013 A | * | 3/1998 | Huang | 70/408 |
| 5,832,761 A | * | 11/1998 | Chen | 70/408 |
| 6,035,677 A | * | 3/2000 | Janssen et al. | 70/408 |
| 6,164,101 A | * | 12/2000 | Kito et al. | 70/408 |
| 6,308,542 B1 | * | 10/2001 | Bolton | 70/408 |
| 6,601,421 B1 | * | 8/2003 | Chaillie | 70/408 |
| 2001/0042392 A1 | * | 11/2001 | Meynier | 70/408 |

FOREIGN PATENT DOCUMENTS

| | | |
|---|---|---|
| EP | 0 715 042 A1 | 6/1996 |
| JP | 07-238721 | 9/1995 |
| JP | 08165824 | 6/1996 |
| JP | 10072959 | 3/1998 |

* cited by examiner

*Primary Examiner*—John B. Walsh
*Assistant Examiner*—Christopher Boswell
(74) *Attorney, Agent, or Firm*—Mark D. Simpson; Synnestvedt & Lechner LLP

(57) ABSTRACT

A key case comprises three parts, a center body, a first case piece, and a second case piece. The center body has a first cavity which side facing the first case piece is opened. The second case piece has four tabs extending toward the first case piece at positions substantially opposite to the peripheral surface of the first cavity. Each tab includes a claw on its distal end. The center body has apertures through which the corresponding tabs can pass therethrough. Following to each aperture, a groove and a shoulder are formed in the peripheral surface of the first cavity. A wireless module is contained in the first cavity while claws pass through the corresponding apertures to be engaged with the shoulders. The wireless module is sized to prevent the claws from disengaging from the shoulders.

18 Claims, 2 Drawing Sheets

KEY DEVICE AND METHOD FOR ASSEMBLING THE SAME

BACKGROUND OF THE INVENTION

The present invention relates to a key device and a method for assembling the same.

Some of conventional key devices have a key case with 2-piece configuration. Such key case contains an electronic part, for example, a wireless module such as a transmitter device for keyless entry.

As shown in FIGS. 3(A) and (B), a 2-piece key case 61 comprises a first case piece 62 and a second case piece 63. A wireless module (not shown) is contained in a space defined by the first case piece 62 and the second case piece 63. A key plate 64 is integrated to the first case piece 62 by insert molding. A female screw is formed in the center body adjacent to the proximal portion of the key plate 64. The second case piece 63 has a hole corresponding to the female screw. Thus, the second case piece 63 is fixed to the first case piece 62 by screwing a screw 65 with the female screw through the hole.

Recently, key cases are desired to have better design appearance as the external appearance of car accessories have been improved. For example, a key case with 3-piece configuration, in which a thick center body is arranged between the first case piece and the second case piece to provide a stately appearance is desired.

In such a 3-piece key case, when a key plate is integrated to the center body by the insert molding, these three parts cannot be integrally secured by a single screw as conventional. For example, the first case piece can be fixed to the center body by a screw. However, it is undesirable to use a long screw for the key case with considering the strength of the screw. When the first case piece and the center body are fitted by a screw, such assembly become thicker. Accordingly, it is impossible to further secure the second case to the assembly by the same single screw which has a normal length.

In such case, the second case may be secured, for example, by adhering, fitting with another screw, or ultrasonic wave welding.

However, adhering requires a long dry time and a place for keeping the key device until the adhesives are dried. Thus, the assembling of the key device becomes troublesome.

If the second case piece is fixed to the center body by another screw, two screws are needed totally. Then the number of parts is increased, causing the manufacturing cost to be raised.

Furthermore, the ultrasonic wave welding is not suitable for the manufacturing of the key device because of the following reasons. When another electronic part such as a transponder is contained in a space defined by the center body and the second case piece, and then the second case piece is fitted to the center body, the ultrasonic wave may adversely affect the electronic part.

For example, Japanese Laid-Open Patent Publication No. 7-238721 discloses a key device having a cavity to contain electronic parts in a case. The above described key device is configured so that the cavity containing the electronic parts can be closed by a cover. The cover has a plurality of claws. By engaging these claws with engaged potions in the case part, the cover can be fitted to the case. However, in this key device, once the cover is attached to the case, the claws cannot be manipulated to release the claws from the engaged portion, and the cover thus cannot be removed. This makes the maintenance of the electronic parts contained in the case impossible. If a battery is included in the electronic parts, the battery also cannot be exchanged.

BRIEF SUMMARY OF THE INVENTION

For deal with above disadvantages, an object of the present invention is to provide a key device with a 3-piece key case that is assembled and disassembled comparatively easily.

Another object of the present invention is to provide a key device with a key case where the electronic parts contained therein can be maintained easily and a method for assembling the same.

In order to achieve the above described objects, the present invention provides a key device having a center body with a first side and a second side opposed to the first side, a first case piece fitted to the first side of the center body, and a second case piece fitted to the second side of the center body. The key device comprises said center body having a first cavity in the first side, wherein the cavity has an inner peripheral surface; a first inner component to be contained in the first cavity; a fitting member formed in the second case piece, wherein the center body has an aperture formed in association with the fitting member; and a receiving member formed in the inner peripheral surface of the first cavity in association with the fitting member to be engaged by the associated fitting member through the associated aperture when the second case piece is fitted with the center body. The first inner component urges the fitting member to prevent the fitting member from disengaging from the receiving member, when the first inner component is placed in the first cavity after the second case piece is fitted to the center body.

In the key device of the present invention, said center body may have a second cavity in the second side. A second inner component may be contained in the second cavity. The fitting member may have a tab having a distal end projecting from the second case piece and a claw formed in the distal end. The tab may extend from the second case piece through the aperture along the inner peripheral surface of the first cavity to the first side when the second case piece is fitted with the center body. In the side facing to the inner peripheral surface of the first cavity, the claw may slightly project from the tab toward the inner peripheral surface side. The receiving member may have a shoulder adapted to be engaged by the claw.

The present invention also provides a method for assembling such key device. The method comprises steps of fitting a second case piece to a center body by inserting a fitting member through an aperture until the fitting member is engaged with the receiving member of the center body; and placing a first inner component in a first cavity, whereby the first inner component urges the fitting member to prevent the fitting member from disengaging from a receiving member.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Hereafter, one embodiment of the present invention embodied as a key device for a vehicle will be described with reference to FIG. 1 and FIG. 2.

Figure 1:
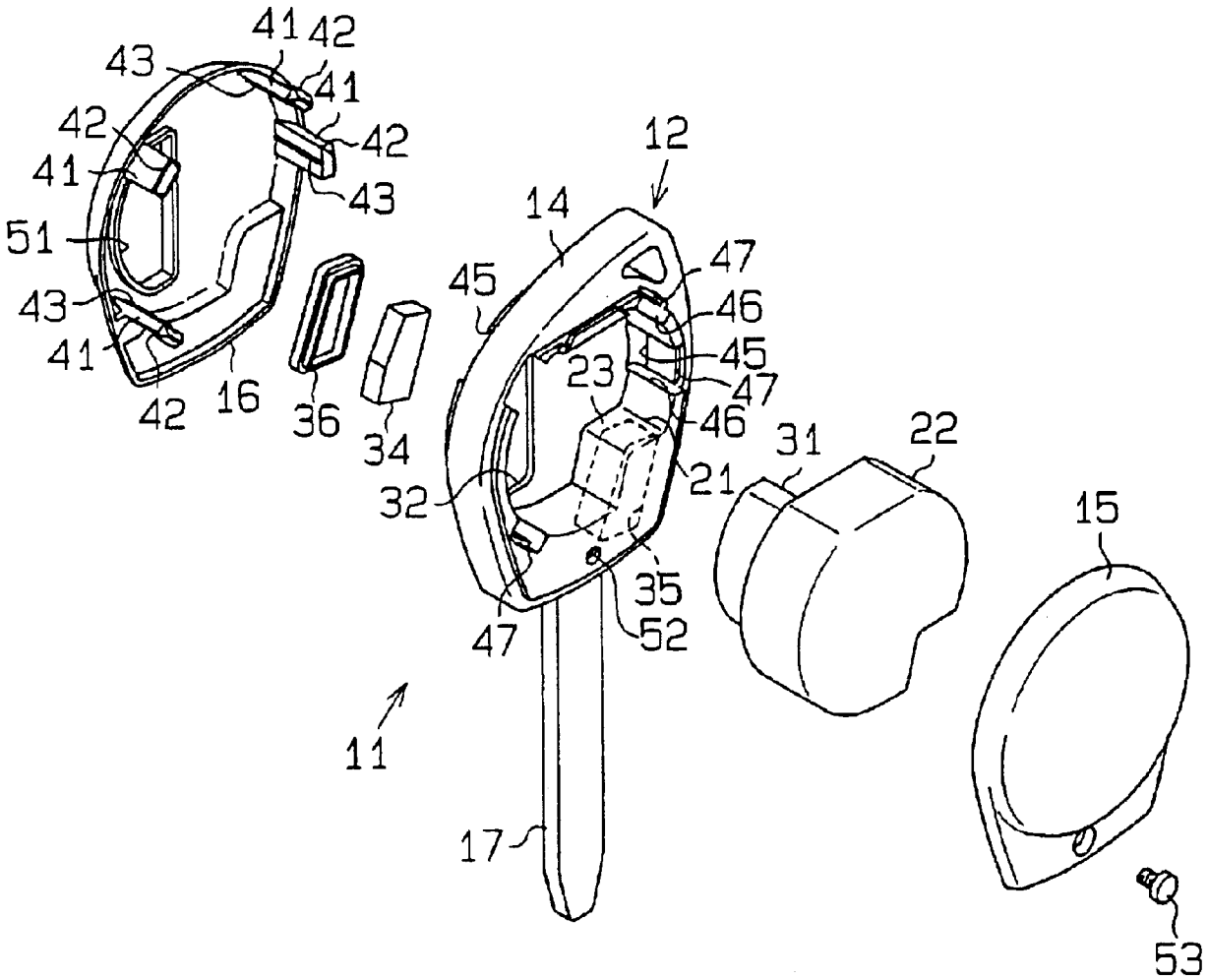
FIG. 1 is a exploded perspective view of a key device according to the present invention.
Figure 2A:
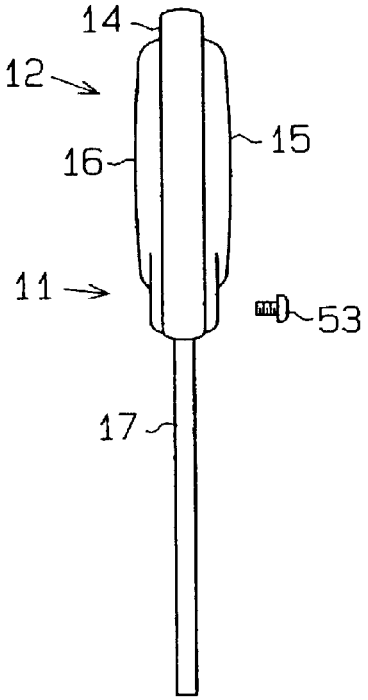
FIG. 2(A) is a side view of a key device according to the present invention.
Figure 2B:
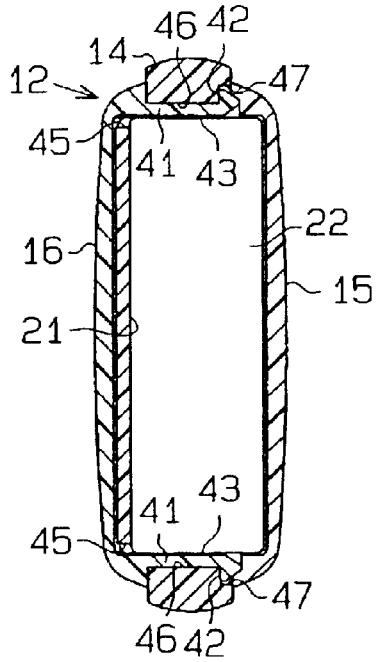
FIG. 2(B) is a cross sectional view of a key device according to the present invention.
Figure 3A:
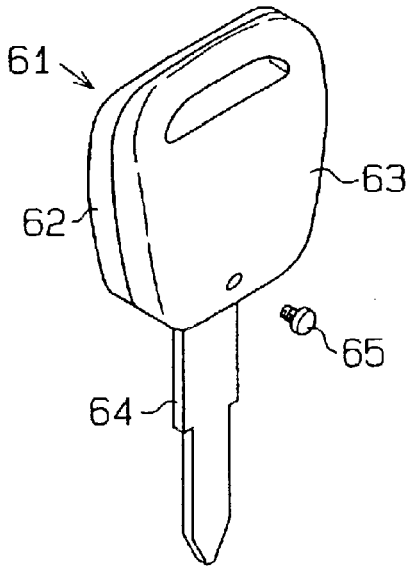
Fig.3(a) (Prior Art)
FIG. 3(A) is a perspective view of a conventional key device.
Figure 3B:
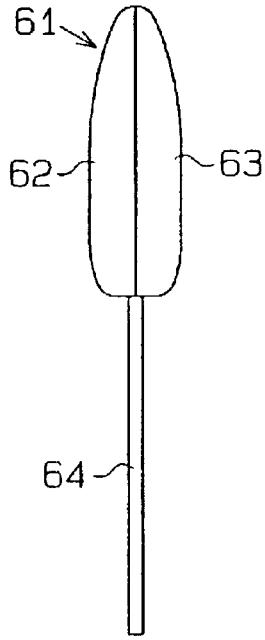
Fig.3(b) (Prior Art)
FIG. 3(B) is a side view of a conventional key device.

FIG. 1 shows a exploded perspective view of a key device in the present embodiment, and FIG. 2(A) shows a side view of the key device, and FIG. 2(B) shows a cross sectional view of a key case of the key device.

As shown in FIG. 1 and FIG. 2(A), a key case 12 of a key device 11 is configured by three parts, that is, a center body 14, a first case piece 15, and a second case piece 16. A key plate 17 is integrated to the center body 14 by the insert molding.

The center body 14 has a first side facing the first case piece 15 and a second side facing the second case piece 16. A first cavity 21, which is opened facing the first case piece 15, is formed in the first side. A wireless module 22 for a keyless entry system is fitted into the first cavity 21. The wireless module 22 has a generally cylindrical shape in which a shape of the horizontal cross section is a partially notched circle. The first cavity 21 has a shape generally corresponding to the wireless module 22. That is, the center body 14 has a projecting part 23 corresponding to a notch of the wireless module 22.

As shown in FIG. 1, the wireless module 22 has an operating button 31 on the side facing the bottom of the first cavity 21. The center body 14 has a button hole 32 at a position corresponding to the operating button 31 at the bottom of the first cavity 21. In this embodiment, the operating button 31 is configured to have generally semi-cylindrical shape. The button hole 32 is shaped and sized to receive the operating button 31 therethrough.

The center body 14 further has a second cavity 35 in the projecting part 23 for accommodating another component, for example, a transponder 34 in this embodiment. The second cavity 35 is opened to face the second case piece 16. In order to hold the transponder 34 in the second cavity 35, a covering member 36 is fitted with the opening of the second cavity 35 to cover the second cavity 35 containing the transponder 34. In this embodiment, the covering member 36 comprises a rubber material.

In the present embodiment, the transponder 34 is part of the engine immobilizer system for the burglary prevention of a vehicle. The engine immobilizer system comprises a transponder 34 incorporated in the key device 11 and a receiver mounted on a vehicle and connected to a computer for controlling an activation of the engine.

The transponder 34 is a battery-less transmitter. The transponder 34 is configured to charge an electrical energy when energized at a specified frequency generated by a main coil connected to a computer of the vehicle. Then the transponder transmits an ID code at the specified frequency by using the electrical energy. A receiver provided on the vehicle is configured to receive the ID code from the transponder 34 through a coil antenna disposed in the peripheral of the key cylinder of the vehicle. The receiver then outputs the received ID code to the computer for controlling an activation of the engine. The computer compares the ID code included in the received signal with a reference code previously stored. If the ID code matches with the reference code, the computer permits to supply fuel to the engine. If the code does not match with the reference code, the computer stops supplying the fuel.

The second case piece 16 has a bottom surface and an inner peripheral wall extending substantially perpendicularly from the bottom surface. The second case piece 16 includes at least one (four in this embodiment) of plate-like tab 41, which extends substantially perpendicularly along the inner peripheral wall from the bottom thereof and projects out of a upper edge of the second case piece. A claw 42 is formed at the distal end of each tab 41. Each claw 42 is formed to radially project out from the tab corresponding 41. Each tab 41 includes a projecting streak 43 slightly projecting from the inner side surface of the tab (surface of the side opposing to the side where the claw is projecting). The projecting streak 43 is formed to extend longitudinally at the center of the surface of the tab 41.

The center body 14 includes apertures 45 at positions corresponding to the tabs 41 for receiving the tabs 41 therethrough. Furthermore, grooves 46 are provided in the inner peripheral wall of the first cavity 21. The grooves 46 are formed at positions corresponding to the apertures 45 by removing parts of the inner peripheral wall toward radially outside so that the tabs 41 can be received in the grooves 46 through the apertures 45. Each groove 46 is radially stepped-out toward outside proximity to the end of the first side of the center body 14 to form a shoulder 47. Each claw 42 engages with the corresponding shoulder 47.

As shown in FIG. 2(B), the wireless module 22 is sized to urge the claws 42 onto the shoulders 47 toward radially outer direction to prevent the claws 42 from disengaging from the shoulders 47, when the wireless module 22 is placed into the first cavity 21 while the claws 42 is engaging with the shoulders 47.

As shown in FIG. 1, the second case piece 16 has a button hole 51 similar to the button hole 32 at a position opposite to the button hole 32 of the center body 14. A female screw 52 is formed in the first side of the center body 14 adjacent to the proximal part of the key plate 17. The first case piece 15 has a hole, through which a male screw can engage with the female screw 52, at a position corresponding to the female screw 52 in the center body 14. The first case piece 15 is fitted to the center body 14 by screwing the screw 53 with the female screw 52 through the hole.

As shown in FIG. 2(B), the first case piece 15 is shaped so that a part of the first case piece 15 abutting against the claws 42 holds the claws 42 in cooperation with the center body 14, while the claws 42 are engaging with the shoulders 47.

For improving the appearance of the key case 12, the center body 14, first case piece 15, and second case piece 16 may have different colors. For example, the first case piece 15 and the second case piece 16 may have same color, and the center body 14 may have a different color from that of the first and second case pieces 15, 16.

The assembling method of a key device configured as abovementioned will now be described.

Firstly, the transponder 34 is placed in the second cavity 35 of the center body 14. Then, the second cavity 35 is closed by the covering member 36.

The tab 41 of the second case piece 16 is inserted from the second side of the center body 14 via the aperture 45 along the groove 46, until the claw 42 engages with the shoulder 47. As a result, the second case piece 16 is fitted to the center body 14.

In the state where the second case piece 16 is fitted to the center body 14, the wireless module 22 is placed in the first cavity 21, so that the operating button 31 of the wireless module 22 passes through the button hole 32 and at least part of the button hole 51. As shown in FIG. 2(B), the wireless module 22 urges the projecting streak 43 radially outward. Therefore, the wireless module 22 prevents the tab 41 from bending radially inward, and accordingly prevents the claws 42 from moving radially inward and disengaging from the shoulders 47. As a result, the claws 42 are locked engaging with the shoulders 47.

Then, the first case piece 15 is placed over the center body 14. The first case piece 15 is secured to the center body 14 by screwing the screw 53 with the female screw 52 to complete the key device 11.

In the key device described above, the operating button 31 can be operated through the button holes 51, 32, to switch between a locked state and an unlocked state of a door in a vehicle (not shown) corresponding to the key device 11 (keyless entry function).

When the key device 11 is inserted into a key cylinder of the specified vehicle (not shown), a computer composing an engine immobilizer system, which is mounted on the vehicle, detects the insertion thereof, and feed a predetermined electric current through the main coil to produce a magnetic field. By the magnetic field, the transponder 34 accumulates electrical energy. The transponder 34 sends a signal including an ID code to the computer by using the accumulated electrical energy. The computer receives the signal sent from the transponder 34 via a coil antenna. The computer compares the ID code included in the received signal with a reference code previously stored therein. If the ID code matches with the reference code, the computer permits to supply fuel, and allow the engine activated by the key operation to continue operating. On the other hand, if the ID code does not match with the reference code, the computer prevents the engine from continuing to operate by stopping the supply of fuel. Consequently, such system prevents the burglar of the vehicle.

Furthermore, the wireless module 22 may need to be removed from the first cavity 21 for the maintenance or replacement of the wireless module 22, or exchange of a battery. In this case, the first case piece 15 is removed from the center body 14 after removing the screw 53 from the female screw 52. Then, the wireless module 22 can be removed from the first cavity 21 by urging the operating button 31 through the button hole 51 toward the interior of the center body from the second case piece 15.

As mentioned above, the wireless module 22 prevents the claws 42 from disengaging from the shoulders 47, so that the second case piece 16 is secured to the center body 14. Thus, such mechanical and structural fixing make the second case piece 16 not to disengage easily from the center body 14, even when the key device receives a shock due to dropping or the like. In addition, this structure allows a rattle-free accommodation of the wireless module 22 in the first cavity 21.

In the key device of the present invention, the second case piece 16 is secured to the center body 14 by the mechanical structure above mentioned, and the first case piece 15 is secured to the center body 14 by screwing. Accordingly, similarly to a conventional 2-piece key case, the 3-piece key case 12 can be assembled by using a single screw 53. Furthermore, the first case piece 15 can be removed from the center body 14 for the removal of the wireless module 22 only by removing the screw 53 from the female screw 52. Thus, the 3-piece key case 12 of the present invention can be assembled and disassembled comparatively easily.

The transponder 34 is contained in the second cavity 35 formed in the second side of the center body 14 facing to the second case piece 16. Therefore, even when the first case piece 15 and the wireless module 22 are removed from the center body 14, the transponder 34 is still hidden in the second cavity 35. Accordingly, such structure reduces a risk for removal and loss of the transponder 34 during the wireless module 22 is removed from the first cavity 21, for example, during exchanging the battery of the wireless module 22.

Each tab 41 has a projecting streak 43 formed on its surface facing to the wireless module 22. This projecting streak 43 assures the contact with the wireless module 22 more surely than that in the case where no projecting streak 43 is formed. This helps the wireless module 22 to urge the claws 42 of the tabs 41 against the shoulders 47.

It should be apparent to those skilled in the art that the present invention may be embodied in many other specific forms without departing from the spirit or scope of the invention. Particularly, it should be understood that the invention may be embodied in the following forms.

A component contained in the second cavity 35 is not limited to the transponder 34, but it may be another component, for example, another electronic part.

The key case 12 may have no second cavity 35 for containing a part such as a transponder 34.

The first cavity 21 and the wireless module 22 are not limited to be formed substantially cylindrical shape, but they may be formed another shape such as a square prism.

The tabs 41 need not have the projecting streaks 43.

The component contained in the key case is not limited to the wireless module 22, but it may be another component such as an electronic part for another applications.

The operating button of the wireless module 22 is not limited to be arranged to project from the second case piece 16. For example, the operating button may be arranged to project from the outer peripheral wall of the center body 14 toward radially outside. In this case, an opening for passing the operating button therethrough at the outer peripheral wall of the center body. When the wireless module is placed in the first cavity, the wireless module is positioned so that the operating button is put in the opening.

Therefore, the present examples and embodiments are to be considered as illustrative and not restrictive and the invention is not to be limited to the details given herein, but may be modified within the scope and equivalence of the appended claims.

What is claimed is:

1. A key device having a center body with a first side and a second side opposed to the first side, a first case piece fitted to the first side of the center body, and a second case piece fitted to the second side of the center body comprising:

said center body having a first cavity in the first side, wherein the cavity has an inner peripheral surface;

a first inner component contained in the first cavity;

a fitting member formed in the second case piece, wherein the center body has an aperture formed in association with the fitting member; and a receiving member formed in the inner peripheral surface of the first cavity in association with the fitting member, wherein the receiving member is engaged by the associated fitting member through the associated aperture, wherein the first inner component pressingly contacts the fitting member to hold the same in the receiving member so as to prevent the fitting member from disengaging from the receiving member.

2. The key device according to claim 1, wherein the fitting member has a tab having a distal end projecting from the second case piece, wherein the tab extends from the second case piece along the inner peripheral surface of the first cavity through the aperture to the first side; and a claw formed at the distal end, wherein, in the side facing the inner peripheral surface of the first cavity, the claw slightly projects from the tab toward the inner peripheral surface side; and wherein the receiving member has a shoulder formed to be engaged by the claw.

3. The key device according to claim 2, wherein the tab has a projecting streak longitudinally extending and contacting with the inner component contained in the first cavity.

4. The key device according to claim 1, wherein the center body has a second cavity for containing a second inner component in the second side.

5. The key device according to claim 4, wherein the second inner component includes a transponder for a vehicle engine immobilizer system.

6. The key device according to claim 1, wherein the center body has a female screw for securing the first case piece to the center body.

7. The key device according to claim 1, further comprising a key plate integrated in the center body by insert molding.

8. A key device having a center body with a first side and a second side opposed to the first side, a first case piece fitted to the first side of the center body, and a second case piece fitted to the second side of the center body comprising:

said center body having a first cavity in the first side and a second cavity in the second side, wherein the first cavity has an inner peripheral surface;

a first inner component contained in the first cavity;

a second inner component contained in the second cavity;

a fitting member formed in the second case piece, wherein the center body has an aperture formed in association with the fitting member, wherein the fitting member has a tab having a distal end projecting from the second case piece and a claw formed in the distal end, wherein the tab extends from the second case piece through the aperture along the inner peripheral surface of the first cavity to the first side, and wherein, in the side facing to the inner peripheral surface of the first cavity, the claw slightly projects from the tab toward the inner peripheral surface side; and a receiving member formed in the inner peripheral surface of the first cavity in association with the fitting member, wherein the receiving member is engaged by the associated fitting member through the aperture and has a shoulder adapted to be engaged by the claw, wherein the first inner component pressingly contacts the fitting member to hold the claw of the fitting member in the shoulder of the receiving member so as to prevent the fitting member from disengaging from the receiving member.

9. The key device according to claim 8, wherein the tab has a projecting streak longitudinally extending and contacting with the inner component contained in the first cavity.

10. The key device according to claim 8, wherein the second inner component includes a transponder for a vehicle engine immobilizer system.

11. The key device according to claim 8, wherein the center body has a female screw for securing the first case piece with the center body.

12. The key device according to claim 8, further comprising a key plate integrated to the center body by insert molding.

13. A method for assembling a key device comprising a center body having a first side and a second side opposed to the first side, a first case piece fitted to the first side of the center body, and a second case piece fitted to the second side of the center body, wherein the key device comprises said center body having a first cavity in the first side, wherein the cavity has an inner peripheral surface; a first inner component to be contained in the first cavity; a fitting member formed in the second case piece, wherein the center body has an aperture formed in association with the fitting member; and a receiving member formed in the inner peripheral surface of the first cavity in association with the fitting member to be engaged by the associated fitting member through the associated aperture when the second case piece is fitted with the center body, the method comprises steps of:

fitting the second case piece to the center body by inserting the fitting member through the aperture until the fitting member is engaged with the receiving member of the center body; and placing the first inner component in the first cavity and pressingly contacting the first inner component with the fitting member after said fitting step, whereby the first inner component holds the fitting member in the receiving member so as to prevent the fitting member from disengaging from the receiving member.

14. The method according to claim 13, further comprising a step of insert-molding a key plate to the center body before the fitting step.

15. The method according to claim 13, further comprising a step of fitting the first case piece to the center body by a screw after the placing step.

16. A method for assembling a key device comprising a center body having a first side and a second side opposed to the first side, a first case piece fitted to the first side of the center body, and a second case piece fitted to the second side of the center body, wherein the key device comprises said center body having a first cavity in the first side and a second cavity in the second side, wherein the first cavity has an inner peripheral surface; a first inner component to be contained in the first cavity; a second inner component to be contained in the second cavity; a fitting member formed in the second case piece, wherein the center body has an aperture formed in association with the fitting member; and a receiving member formed in the inner peripheral surface of the first cavity in association with the fitting member to be engaged by the associated fitting member through the associated aperture when the second case piece is fitted with the center body, and the method comprising steps of:

placing the second inner component in the second cavity;

fitting the second case piece to the center body by inserting the fitting member through the aperture until the fitting member is engaged with the receiving member of the center body; and placing the first inner component in the first cavity and pressingly contacting the first inner component with the fitting member after said fitting step, whereby the first inner component holds the fitting member in the receiving member so as to prevent the fitting member from disengaging from the receiving member.

17. The method according to claim 16, further comprising a step of insert-molding the key plate to the center body before the step of placing the second inner component in the second cavity.

18. The method according to claim 16, further comprising a step of securing the first case piece with the center body by a screw after the step of placing the first inner component in the first cavity.

* * * * *